US012535305B2

(12) United States Patent
Gilfillan

(10) Patent No.: US 12,535,305 B2
(45) Date of Patent: Jan. 27, 2026

(54) PYROTECHNIC MOUNTING DEVICE

(71) Applicant: Ingram Enterprises, Inc., Springfield, MO (US)

(72) Inventor: Kevin Gilfillan, Rocklin, CA (US)

(73) Assignee: INGRAM ENTERPRISES, INC., Springfield, MO (US)

( * ) Notice: Subject to any disclaimer, the term of this patent is extended or adjusted under 35 U.S.C. 154(b) by 5 days.

(21) Appl. No.: 18/661,219

(22) Filed: May 10, 2024

(65) Prior Publication Data

US 2024/0377170 A1 Nov. 14, 2024

Related U.S. Application Data

(60) Provisional application No. 63/466,202, filed on May 12, 2023.

(51) Int. Cl.
*F42B 4/20* (2006.01)

(52) U.S. Cl.
CPC ..... *F42B 4/20* (2013.01)

(58) Field of Classification Search
CPC ..... F42B 4/20
See application file for complete search history.

(56) References Cited

U.S. PATENT DOCUMENTS 2,181,819 A * 11/1939 Radelet et al. ..... F41F 1/085 89/37.02
3,708,563 A * 1/1973 Sells ..... F42B 39/26 264/46.7
4,222,306 A * 9/1980 Maury ..... F42B 5/035 102/342
5,269,214 A * 12/1993 Badura ..... F41F 1/08 42/105
5,429,053 A * 7/1995 Walker ..... F42B 4/20 102/342
7,007,584 B2 * 3/2006 Caballer Barat ..... F42B 4/20 89/1.816
7,293,492 B2 * 11/2007 Brunn ..... F42B 12/46 89/1.807
8,490,532 B2 * 7/2013 Barlow ..... F41A 23/24 89/1.41
8,536,500 B2 * 9/2013 Glasson ..... F41F 1/08 89/1.816
9,970,738 B2 * 5/2018 Garcia Gamon ..... F42B 4/20
11,402,182 B2 * 8/2022 Ingram ..... F42B 4/20
11,885,602 B2 * 1/2024 Xinghua ..... F42B 4/30
2001/0015126 A1 * 8/2001 Grunewald ..... F41F 1/08 89/1.41
2004/0120152 A1 * 6/2004 Bolta ..... F21V 29/777 362/249.02
2022/0113113 A1 * 4/2022 Decker ..... F42B 4/20
2024/0377170 A1 * 11/2024 Gilfillan ..... F42B 4/20

* cited by examiner

*Primary Examiner* — Michelle Clement
(74) *Attorney, Agent, or Firm* — NIXON & VANDERHYE P.C.

(57) ABSTRACT

An assembly for mounting pyrotechnic devices includes a framework and a mounting bar secured to the framework and pivotable on a shoulder bolt secured in the framework. The mounting bar has a tube slot therein. At least one tube is securable in the tube slot, where the at least one tube is configured to support the pyrotechnic devices in the framework. The mounting bar is selectively lockable in a pivot position.

18 Claims, 6 Drawing Sheets

PYROTECHNIC MOUNTING DEVICE

CROSS-REFERENCES TO RELATED APPLICATIONS

This application claims the benefit of U.S. Provisional Patent Application No. 63/466,202, filed May 12, 2023, the entire content of which is herein incorporated by reference.

STATEMENT REGARDING FEDERALLY SPONSORED RESEARCH OR DEVELOPMENT (NOT APPLICABLE)

BACKGROUND

The present invention relates to pyrotechnic devices and, more particularly, to a safe, versatile, and simple assembly for mounting pyrotechnic devices in conjunction with professional pyrotechnic displays.

Professional pyrotechnic displays have become increasingly more technical and complex. The sky is the limit in terms of what a pyrotechnician can dream up as they design a professional display. When it comes time to bring that design to reality, the "how" becomes an increasingly large challenge.

There are several products in the marketplace that provide some functionality in this space. None offers the versatility of the described embodiments. Existing pyrotechnic props require more time, money, and energy. Some allow unlimited angles for mounting pyrotechnic devices, but these angles are notorious for slipping after being set. This results in extra work for the user to reset angles and/or a sloppy show performance. Some offer a wide array of preset angles, but those angles are fixed in place and cannot be adjusted. This means wasted space for shows that do not utilize every angle in every display, and the user ultimately requires more props. Some utilize a sliding system to mount pyrotechnic devices, but these mounting bars/slats are fixed at a certain angle. To achieve additional angles, extra components and work are required.

Propping systems on the market are also large and bulky for storage and transportation.

SUMMARY

The device of the described embodiments allows the user to bring designs to reality requiring less time, money, and energy. Professional pyrotechnicians yearn for a singular prop that can work for any show and at any venue. By example, for one show, the technician may need all the devices shot straight up. For another show, the technician may need devices set at three or five different angles per prop. The device of the described embodiments is designed to accommodate these objectives.

In an exemplary embodiment, an assembly for mounting pyrotechnic devices includes frame rails and a plurality of mounting bars secured between the frame rails. The mounting bars are pivotable on respective shoulder bolts secured in the frame rails. An articulation plate secured at one end of each of the mounting bars includes pin apertures therein, a plurality of locking pins are respectively engageable with one of the pin apertures on each of the articulation plates.

The mounting bars may include a tube slot, and a plurality of tubes may be securable to the mounting bars in the tube slots. Tube stops may be secured in the tube slots that engage the tubes to secure the tubes in the tube slots. Each of the plurality of tubes may include a mounting plate at a bottom end that is sized to fit into the tube slots of the mounting bars. The mounting bars may include side rails on opposite sides of a sliding surface, and at least a portion of the side rails may include a shoulder that defines the tube slots. The shoulders may be spaced from an insert end of the mounting bars.

The assembly may additionally include a setting plate secured to an end of each of the mounting bars opposite from the articulation plate, where the setting plates have pin apertures therein, and a plurality of setting pins respectively engageable with one of the pin apertures on each of the setting plates.

The frame rails may include side frame rails and end frame rails connected between the side frame rails, where the end frame rails may include handles therein.

In another exemplary embodiment, an assembly for mounting pyrotechnic devices includes a framework, a mounting bar pivotally secured to the framework and having a tube slot therein, and at least one tube securable in the tube slot, where the at least one tube is configured to support the pyrotechnic devices in the framework. The mounting bar is selectively lockable in a pivot position.

BRIEF DESCRIPTION OF THE DRAWINGS

These and other aspects and advantages will be described in detail with reference to the accompanying drawings, in which.

DETAILED DESCRIPTION

Figure 1:
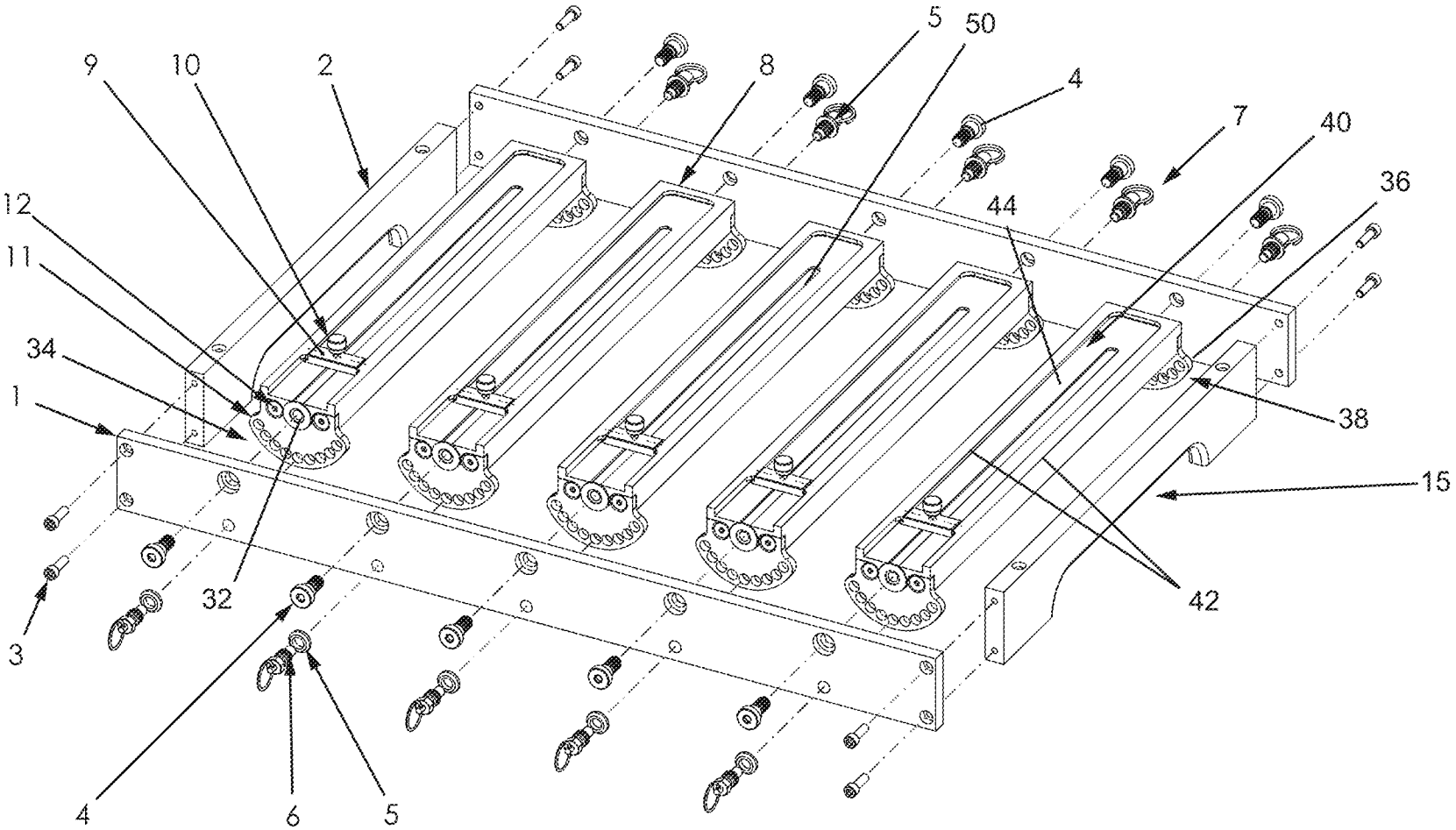
FIG. 1 is an exploded view showing the component parts of the mounting assembly according to the described embodiments.
Figure 2:
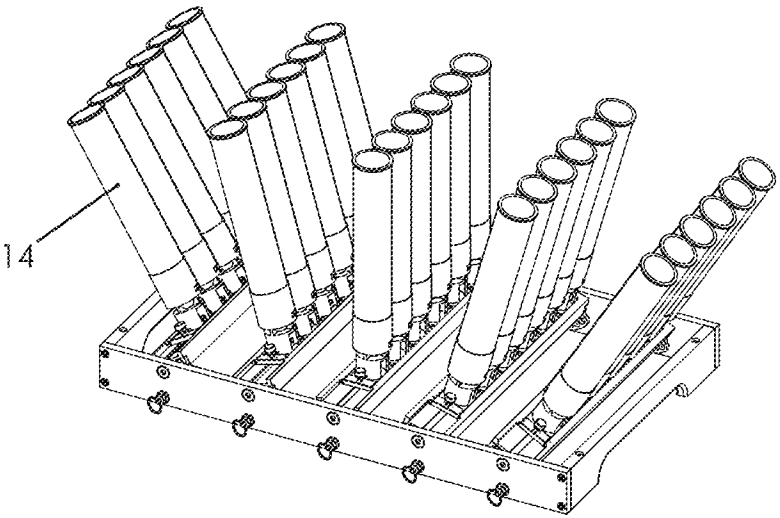
FIG. 2 shows the assembly with a plurality of tubes installed to support the pyrotechnic devices in the framework.

With reference to FIGS. 1 and 2, the assembly includes frame rail sides 1 and frame rail ends 2 connected between the frame rail sides 1 to define a framework. The side frame rails 1 are secured to the end frame rails 2 via cap screws 3 or the like. As shown, the end frame rails 2 may be provided with handles 15 making the assembly easier to pick up and move. Each of the frame rail ends 2 may be provided with holes (two shown) that allow for bolt mounting to other props or structures.

At least one mounting bar 8 is secured between the side frame rails 1. In an exemplary embodiment, as shown, each assembly may include five mounting bars 8. The mounting bars 8 are secured via shoulder bolts 4 or the like in the side frame rails 1. The mounting bars 8 may be provided with a central slot 50.

An articulation plate 11 is secured at one end of each of the mounting bars 8. Each articulation plate 11 includes connecting holes 12 for receiving connectors to secure the articulation plate 11 to the mounting bar 8 and an axle opening 32 for receiving the shoulder bolt 4. The articulation plates 11 also include a plurality of pin apertures 34 in an arcuate array at a bottom of the articulation plate 11. Locking pins 6 including pin spacers 5 are respectively engageable with one of the pin apertures 34 on each of the articulation plates 11.

Figure 3B:
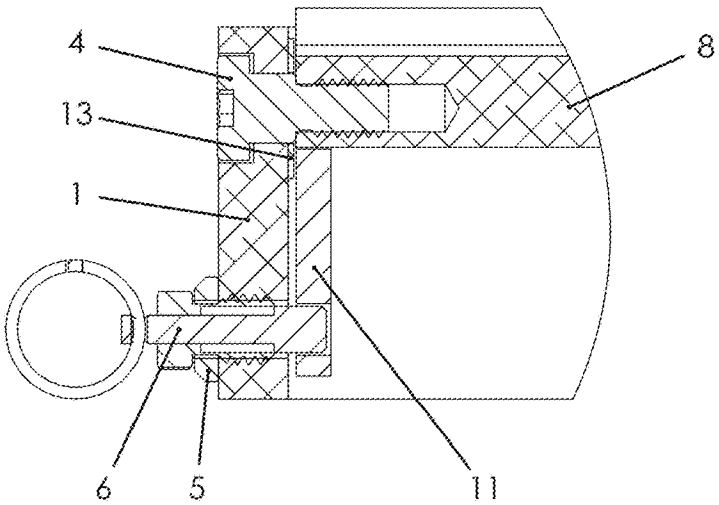
FIGS. 3A and 3B show details of an articulation plate secured to the mounting bars.
Figure 3A:
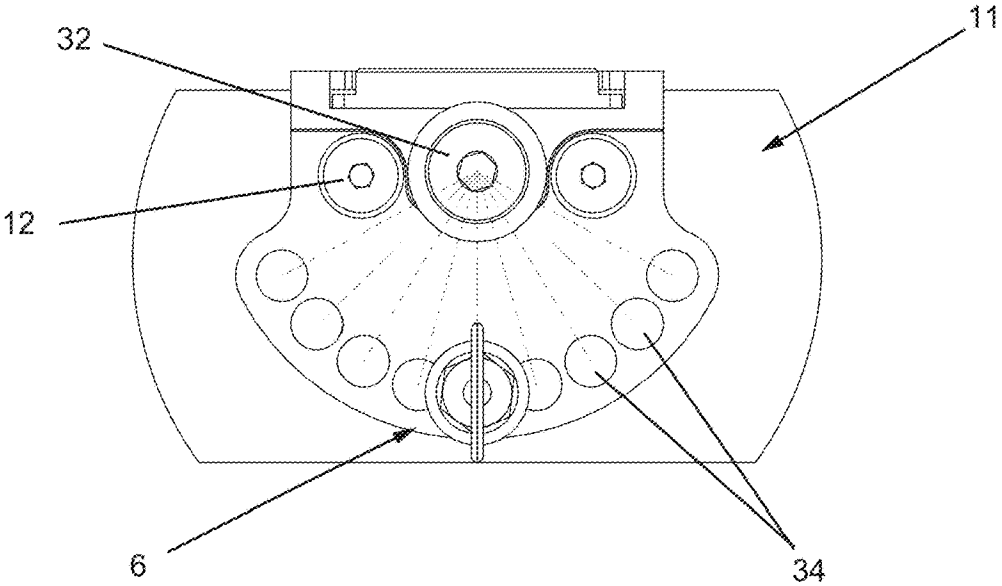

FIG. 3A shows details of the articulation plate 11. FIG. 3B is a sectional view through the side frame rail 1 and through the locking pin 6. As described, the mounting bar 8 is pivotable on the shoulder screw 4, and the locking pin 6 locks an angular position of the mounting bar 8 via the apertures 34 in the articulation plate 11.

A setting plate 36 may be secured to an end of each of the mounting bars 8 opposite from the articulation plates 11. The setting plates 36 similarly include a plurality of pin apertures 38 therein. Setting pins 7 are respectively engageable with one of the pin apertures 38 on each of the setting plates 36. The setting pins 7 are configured such that they can be set to an open position without requiring a user to hold the pin.

Figure 5:
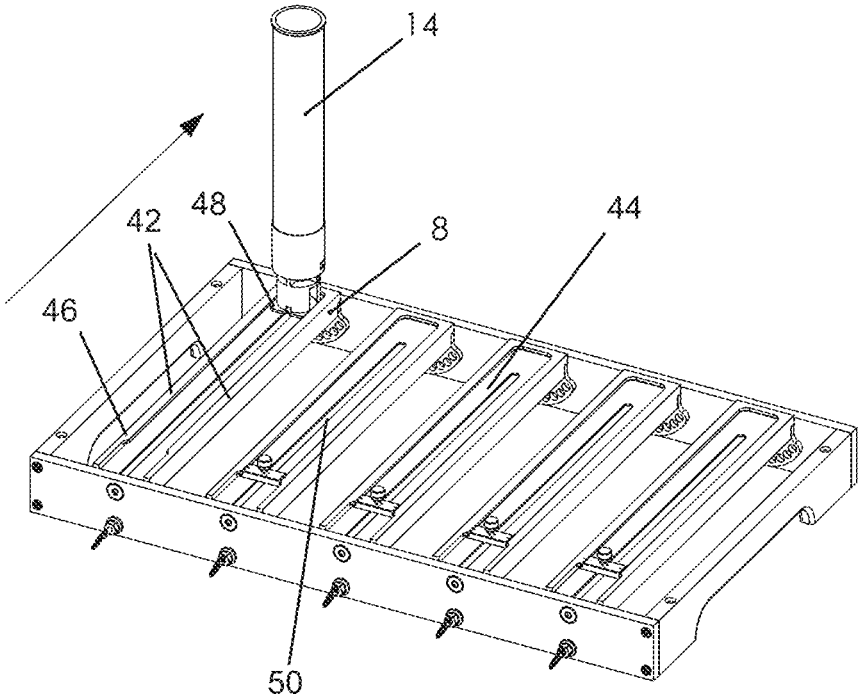

Each of the mounting bars 8 is provided with a tube slot 40 defined by side rails 42 on opposite sides of a sliding surface 44. With particular reference to FIG. 5, at least a portion of the side rails 42 includes a shoulder 46 extending over the sliding surface 44 to define the tube slots 40. As shown, the shoulders 46 are spaced from an insert end of the mounting bars 8. The tube slots 40 may be in the form of machined ridges on either side of the mounting bars 8 that hold the tubes 14 and pyrotechnic devices in place.

Each of the tubes 14 may be provided with a mounting plate 48 at a bottom end that is sized to fit into the tube slots 40 of the mounting bars 8. The mounting plates 48 fit in the slot 40 between the shoulders 46 of the rails 42 and the sliding surface 44. That is, individual tubes 14 can slide onto the mounting bar 8 under the ridges on either side.

A tube stop 9 may be secured in the tube slot 40 via a thumbscrew 10 or the like to secure the tubes 14 in the tube slots 40.

Figure 4:
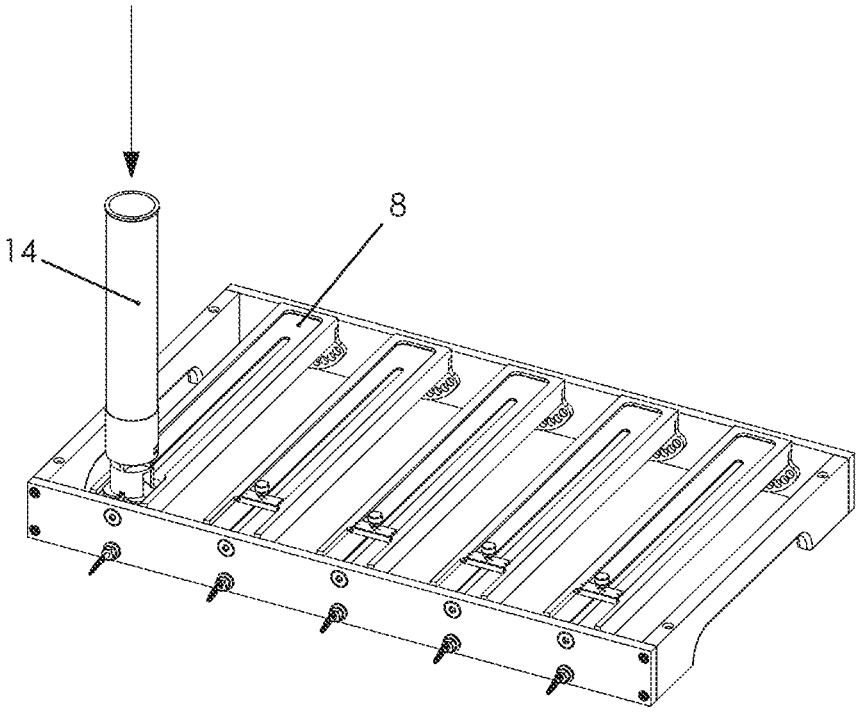
FIGS. 4-6 show a process for loading the tubes onto the mounting bars.
Figure 6:
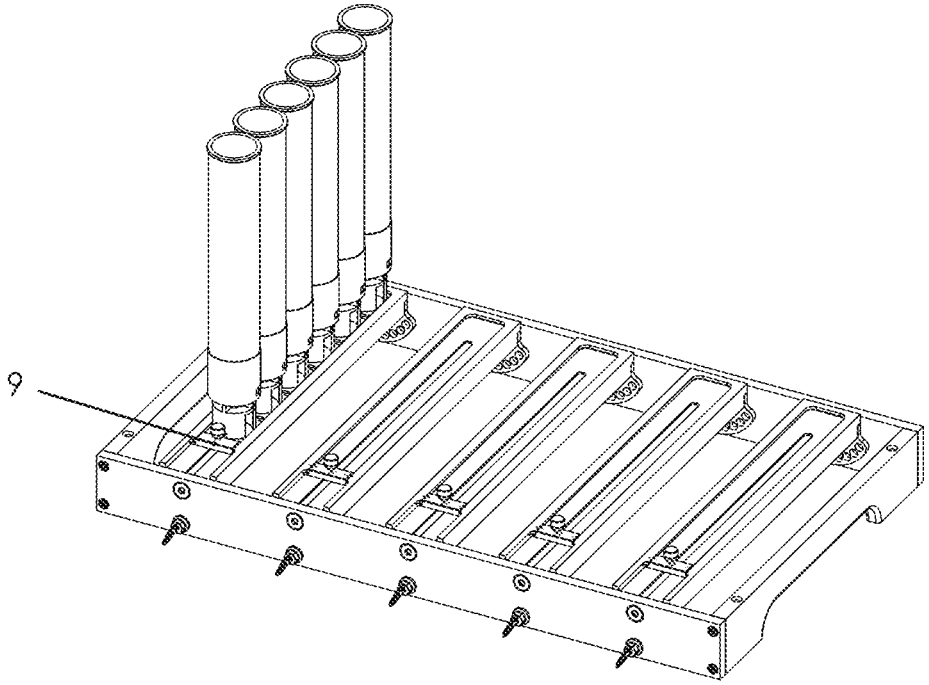

FIGS. 4-6 show a process for securing six tubes 14 onto one of the mounting bars 8. As shown in FIG. 4, a first tube 14 is set into the slot of the mounting bar 8 and slid on the sliding surface 44 from an insert end toward an opposite end as shown in FIG. 5. Because the shoulder 46 is spaced from the insert end of the mounting bar 8, the mounting plate 48 can be readily inserted into the slot 40. The insert process is repeated for additional tubes 14. When the desired number of tubes 14 is secured on the mounting bar 8, the tube stop 9 is inserted into the slot 40 into engagement with the tubes 14 to secure the tubes in the tube slot. The thumbscrew 10 extends through the central slot 50 to engage a nut or other connector to lock the tube stop 9 in place. The locked tube stop secures the tubes 14 so that the tubes 14 will not move during discharge.

Figure 8:
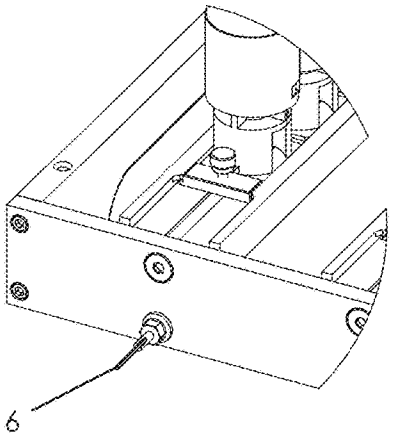
FIG. 8 shows a locking pin on a front side of the framework.
Figure 7:
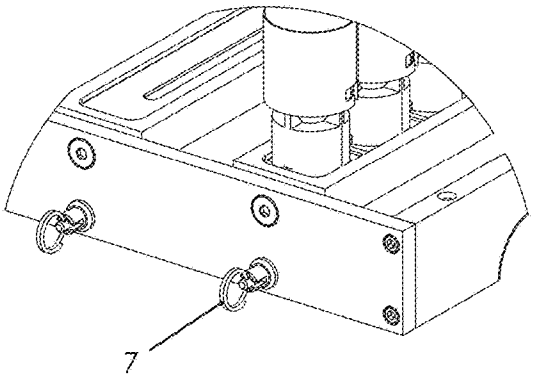
FIG. 7 shows a setting pin on a back side of the framework.

With reference to FIGS. 7 and 8, the locking pin 6 that engages the articulation plate 11 is positioned on one of the side frame rails 1, and the setting pin 7 that engages the setting plate 36 extends through the opposite side frame rail 1. The articulation plate 11 aligns with a machined hole in the side frame rail 1, and the locking pin 6 slides through the side frame rail 1 and the articulation plate 11. In some embodiments, each mounting bar 8 can be set at a maximum of nine different firing angles, although more or fewer angles could be accommodated.

Figure 9:
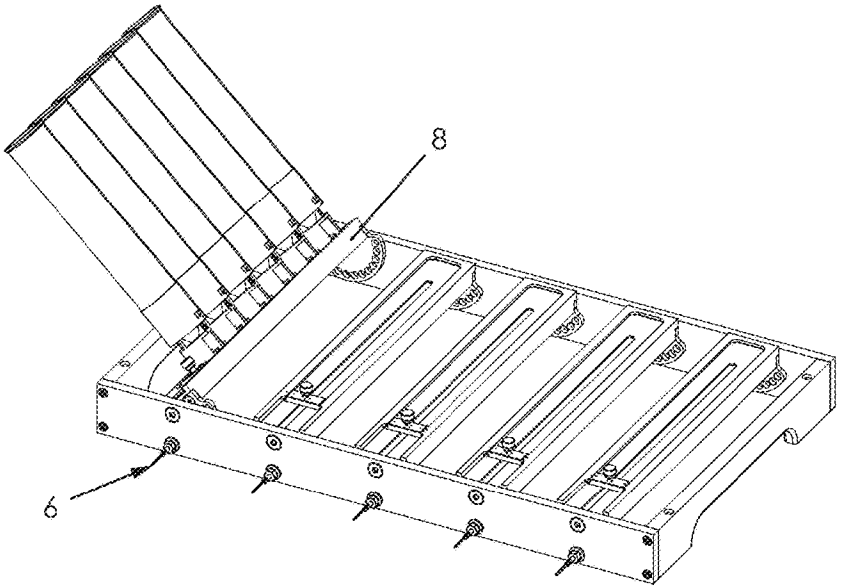
FIG. 9 shows the assembly with one row of tubes secured to a mounting bar and set in a pivot position.

The setting pin 7 allows the mounting bar angle to be set by just one user. After installing the tubes 14, the user engages the setting pin 7 on the rear frame rail 1 to set in an open position. Subsequently, the user uses one hand to release the locking pin 6 on the front frame rail 1 and the other hand to adjust the angle of the mounting bar 8 to a desired angle. Once the angle is set, the user engages the locking pin 6 and the setting pin 7, and the angle is locked in place. FIG. 9 shows an exemplary configuration with the mounting bar 8 set at a desired angle.

The assembly of the described embodiments facilitates mounting and setting of pyrotechnic devices using a plurality of selectively positionable mounting bars and a plurality of support tubes for each mounting bar that secure the pyrotechnic devices. The assembly is operable by a single user and can be easily transported and stored.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. An assembly for mounting pyrotechnic devices comprising:

frame rails;

a plurality of mounting bars secured between the frame rails, wherein the mounting bars are pivotable on respective shoulder bolts secured in the frame rails;

an articulation plate secured at one end of each of the mounting bars, the articulation plates including pin apertures therein; and a plurality of locking pins respectively engageable with one of the pin apertures on each of the articulation plates.

2. An assembly according to claim 1, wherein the mounting bars comprise a tube slot, and wherein a plurality of tubes are securable to the mounting bars in the tube slots.

3. An assembly according to claim 2, further comprising tube stops secured in the tube slots, the tube stops engaging the tubes to secure the tubes in the tube slots.

4. An assembly according to claim 2, wherein each of the plurality of tubes comprises a mounting plate at a bottom end that is sized to fit into the tube slots of the mounting bars.

5. An assembly according to claim 4, wherein the mounting bars comprise side rails on opposite sides of a sliding surface, and wherein at least a portion of the side rails comprises a shoulder that defines the tube slots.

6. An assembly according to claim 5, wherein the shoulders are spaced from an insert end of the mounting bars.

7. An assembly according to claim 1, further comprising:

a setting plate secured to an end of each of the mounting bars opposite from the articulation plate, the setting plates including pin apertures therein; and a plurality of setting pins respectively engageable with one of the pin apertures on each of the setting plates.

8. An assembly according to claim 1, wherein the frame rails comprise side frame rails and end frame rails connected between the side frame rails, wherein the end frame rails comprise handles therein.

9. An assembly for mounting pyrotechnic devices comprising:

a framework;

a mounting bar pivotally secured to the framework, the mounting bar including a tube slot therein; and at least one tube securable in the tube slot, the at least one tube being configured to support the pyrotechnic devices in the framework, wherein the mounting bar is selectively lockable in a pivot position.

10. An assembly according to claim 9, further comprising:

an articulation plate secured at one end of the mounting bar, the articulation plate including pin apertures therein; and a locking pin engageable with one of the pin apertures in the articulation plate.

11. An assembly according to claim 10, further comprising a setting plate secured to an end of the mounting bar opposite from the articulation plate, the setting plate including pin apertures therein; and a setting pin engageable with one of the pin apertures on the setting plate.

12. An assembly according to claim 9, wherein the at least one tube comprises a mounting plate at a bottom end that is sized to fit into the tube slot of the mounting bar.

13. An assembly according to claim 12, wherein the mounting bar comprises side rails on opposite sides of a sliding surface, and wherein at least a portion of the side rails comprises a shoulder that defines the tube slot.

14. An assembly according to claim 13, wherein the shoulders are spaced from an insert end of the mounting bar.

15. An assembly according to claim 9, wherein the mounting bar is sized to receive a plurality of tubes.

16. An assembly according to claim 15, further comprising a tube stop secured in the tube slot after a desired number of mounting tubes is secured in the tube slot.

17. An assembly according to claim 9, comprising a plurality of mounting bars secured in the framework.

18. An assembly according to claim 9, wherein the mounting bar is pivotable on a shoulder bolt secured in the framework.

* * * * *